US010238912B2

(12) United States Patent
Chen

(10) Patent No.: US 10,238,912 B2
(45) Date of Patent: Mar. 26, 2019

(54) CURVED TREADMILL

(71) Applicant: YING LIANG HEALTH TECH. CO., LTD., Taoyuan (TW)

(72) Inventor: Chih Liang Chen, Taoyuan (TW)

(73) Assignee: YING LIANG HEALTH TECH. CO., LTD., Taoyuan (TW)

( * ) Notice: Subject to any disclaimer, the term of this patent is extended or adjusted under 35 U.S.C. 154(b) by 56 days.

(21) Appl. No.: 15/459,846

(22) Filed: Mar. 15, 2017

(65) Prior Publication Data

US 2018/0264315 A1 Sep. 20, 2018

(51) Int. Cl.
*A63B 22/02* (2006.01)
*A63B 21/00* (2006.01)

(52) U.S. Cl.
CPC ..... *A63B 22/0285* (2013.01); *A63B 21/4034* (2015.10); *A63B 21/4035* (2015.10); *A63B 22/0214* (2015.10)

(58) Field of Classification Search
CPC ..... A63B 21/4034; A63B 21/4035; A63B 22/0285; A63B 22/0214
See application file for complete search history.

(56) References Cited

U.S. PATENT DOCUMENTS 9,987,516 B1 * 6/2018 Chen ..... A63B 22/0285
2004/0242378 A1 * 12/2004 Pan ..... A63B 22/02 482/54
2006/0205568 A1 * 9/2006 Huang ..... A63B 22/02 482/54
2007/0225127 A1 * 9/2007 Pan ..... A63B 22/02 482/54
2012/0270704 A1 * 10/2012 Wang ..... A63B 22/02 482/54
2013/0053222 A1 * 2/2013 Lo ..... A63B 22/02 482/54
2013/0281241 A1 * 10/2013 Watterson ..... A63B 22/0285 474/268
2016/0144224 A1 * 5/2016 Dalebout ..... A63B 22/02 482/54
2016/0367851 A1 * 12/2016 Astilean ..... B62K 7/00

* cited by examiner

*Primary Examiner* — Megan Anderson
(74) *Attorney, Agent, or Firm* — Shimokaji IP

(57) ABSTRACT

A curved treadmill has a frame assembly, a handrail assembly, and a belt assembly. The frame assembly has a support frame, two arced guide tracks, two cushions, multiple guide wheels, and multiple positioning wheels. Each arced guide track is concaved downward. The cushions are mounted on the arced guide tracks. The guide wheels are mounted on the support frame. The positioning wheels are mounted between two ends of the support frame. The belt assembly includes two connection belts and multiple pedals. The connection belts are wrapped around the guide wheels, and one side of each connection belt abuts the positioning wheels. The pedals are mounted on the connection belts and optionally abut the cushions. Therefore, with the cushions, impacts may be absorbed and noises may be reduced. Besides, by abutting the positioning wheels, the connection belt may not be distorted sideward, and the noises are reduced further.

9 Claims, 7 Drawing Sheets

CURVED TREADMILL

BACKGROUND OF THE INVENTION

1. Field of the Invention

The present invention relates to fitness equipment, and more particularly to a curved treadmill.

2. Description of the Prior Arts

Some conventional treadmills are curved treadmills. The conventional curved treadmill comprises a frame assembly, a belt wrapped around the frame assembly, and multiple pedals securely mounted on the belt. When exercising, a user stamps on the pedals, which causes rollers at two ends of the pedals to impact the frame assembly and thus noises are generated. Furthermore, the rollers and the frame assembly are made from rigid materials, so that the noises are loud.

Besides, in concern with both material economizing and mechanical strength, many components are made by hollow tubes. Therefore, a resonant cavity is formed in each hollow tube, so that sound generated by each pace stamped on the treadmill is magnified and becomes annoying.

In addition, to prevent the pedals from moving sideward because of lateral forces, the frame assembly of the conventional treadmill forms a groove as a track, so that the rollers of the pedals can move in the groove and thus moving ranges of the rollers are restricted. However, when moving sideward, the rollers in the track may collide with the side walls of the track, and noises are generated, too.

To overcome the shortcomings, the present invention provides a curved treadmill to mitigate or obviate the aforementioned problems.

SUMMARY OF THE INVENTION

The main objective of the present invention is to provide a curved treadmill that makes little noise.

The curved treadmill has:

a frame assembly comprising:

a support frame;

two arced guide tracks being concaved downward and disposed on two opposite sides of the support frame respectively;

two cushions mounted securely on upper surfaces of the two arced guide tracks respectively;

a plurality of guide wheels mounted on a front end and a rear end of the support frame; and a plurality of positioning wheels mounted between the front end and the rear end of the support frame;

a handrail assembly mounted on two opposite sides of the frame assembly and comprising a handrail; and a belt assembly wrapped around the frame assembly, and comprising:

at least one connection belt wrapped around the plurality of guide wheels, and one side of the at least one connection belt abutting or adjacent to the plurality of positioning wheels; and a plurality of pedals securely mounted on the at least one connection belt, juxtaposed and adjacent to each other;

and downward and optionally wherein when some of the plurality of pedals are right above the two cushions, bottom surfaces of said some of the plurality of pedals abut the two cushions that are mounted on the two arced guide tracks.

Consequently, as the cushions are mounted on the arced guide tracks, impacts may be absorbed so that noises may be reduced. Besides, abutting or being adjacent to the positioning wheels, the at least one connection belt may not be distorted sideward but move smoothly around the support frame, and noises may not be generated.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
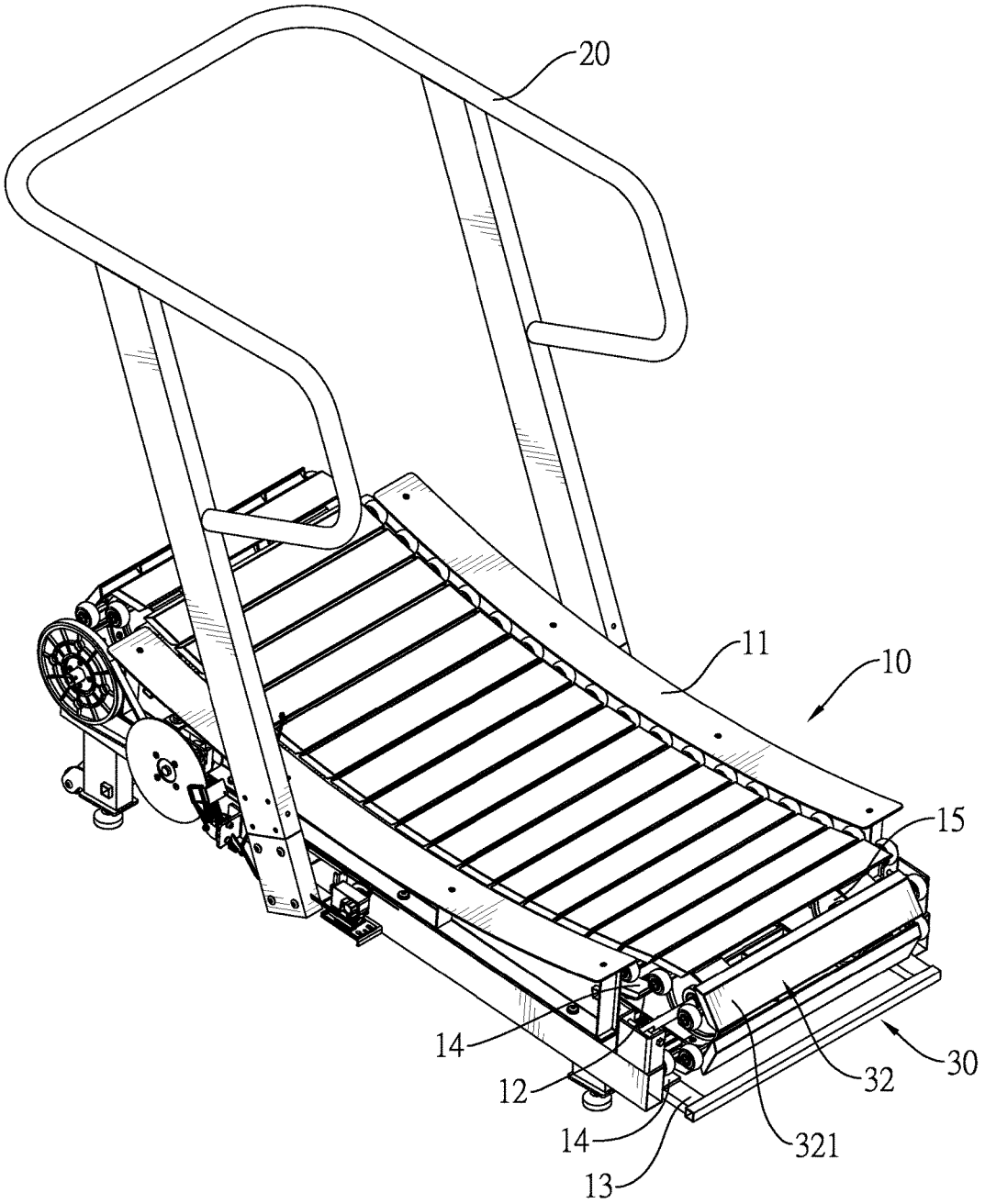
FIG. 1 is a perspective view of a curved treadmill in accordance with the present invention.

With reference to FIG. 1, a curved treadmill in accordance with the present invention comprises a frame assembly 10, a handrail assembly 20, and a belt assembly 30.

Figure 2:
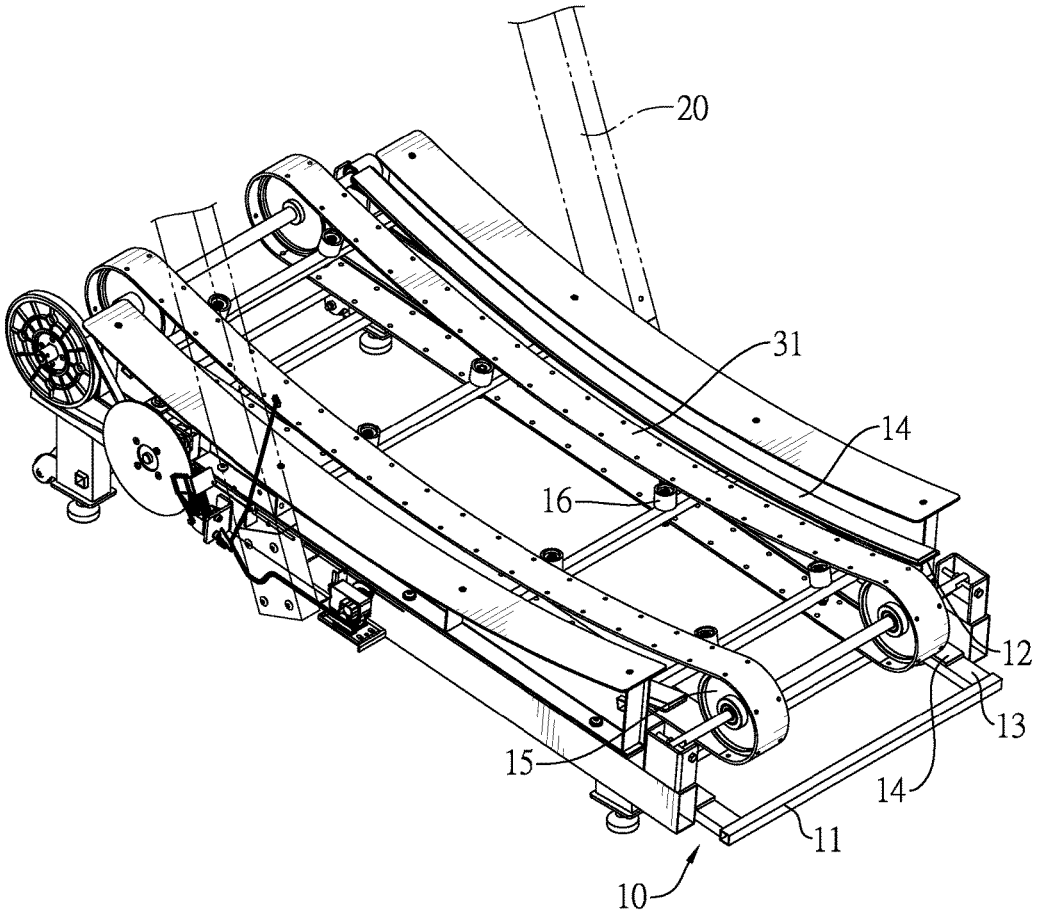
FIG. 2 is a perspective view of a frame assembly of the curved treadmill in FIG. 1.

And then please refer to FIG. 2. The frame assembly 10 comprises a support frame 11, two arced guide tracks 12, two straight guide tracks 13, four cushions 14, a plurality of guide wheels 15 and a plurality of positioning wheels 16.

The arced guide tracks 12 and the straight guide tracks 13 are spaced apart from each other in a vertical direction. Each one of the arced guide tracks 12 is a sheet and is downward concaved, and the two arced guide tracks 12 are mounted on two sides of the support frame 11. Each one of the straight guide tracks 13 is a hollow tube, and the two straight guide tracks 13 are mounted on the two sides of the support frame 11 and under the two arced guide tracks 12 respectively. Two of the four cushions 14 are mounted securely on upper surfaces of the two arced guide tracks 12 respectively, and the remaining two cushions 14 are mounted securely on upper surfaces of the two straight guide tracks 13.

The guide wheels 15 are mounted on a front end and a rear end of the support frame 11. There are four guide wheels 15 in this embodiment, two guide wheels 15 are juxtaposed and spaced apart from each other at the front end of the support frame 11, and the remaining two guide wheels 15 are juxtaposed and spaced apart from each other at the rear end of the support frame 11. The positioning wheels 16 are mounted between the front end and the rear end of the support frame 11. In this embodiment, the positioning wheels 16 are arranged in two lines along a longitudinal direction of the support frame 11 and between two of the guide wheels 15.

The handrail assembly 20 is securely mounted on the two sides of the frame assembly 10 and comprises a handrail.

Figure 3A:
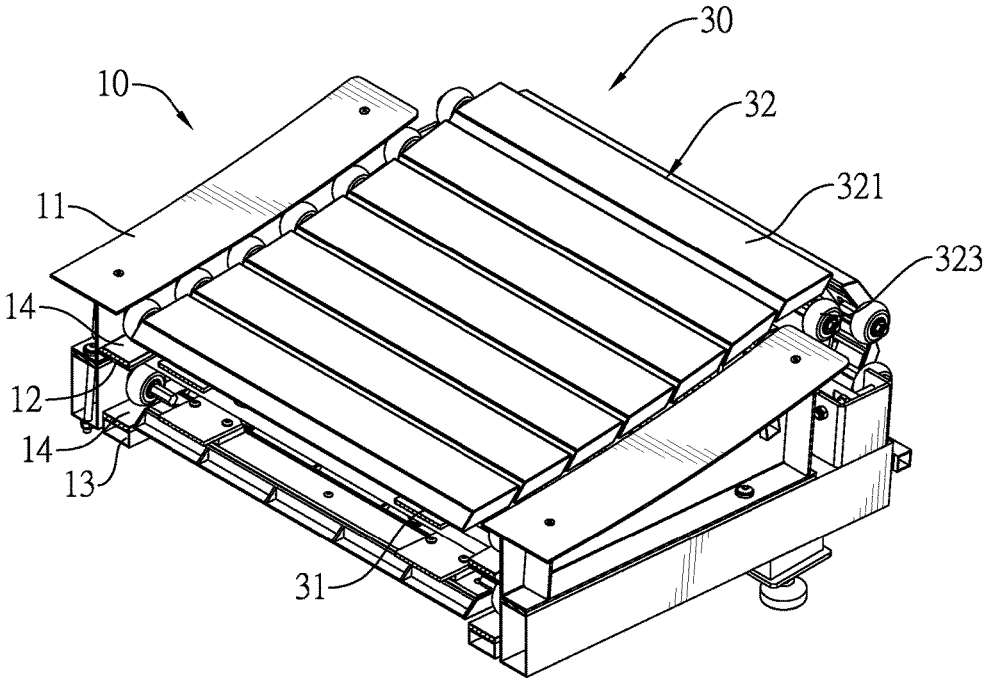
FIG. 3A is a sectional perspective view of the curved treadmill in accordance with the present invention.
Figure 3B:
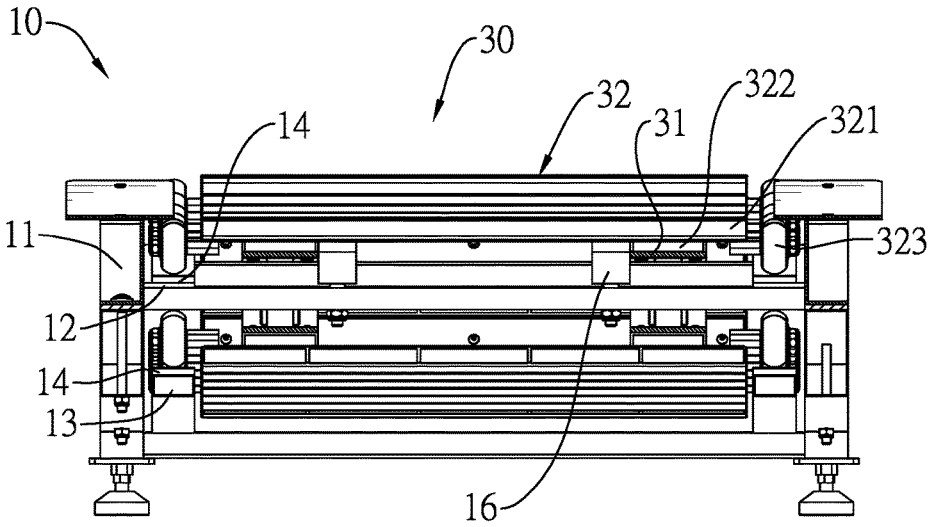
FIG. 3B is a sectional view of the curved treadmill in accordance with the present invention.

Then refer to FIGS. 2, 3A and 3B. The belt assembly 30 is wrapped around the frame assembly 10. Precisely, the belt assembly 30 is wrapped around the arced guide tracks 12, the straight guide tracks 13, and the guide wheels 15. The belt assembly 30 comprises at least one connection belt 31 and a plurality of pedals 32. In this embodiment, a number of the at least one connection belt 31 is two. Each one of the two connection belts 31 is wrapped around the guide wheels 15, and one side of each connection belt 31 abuts or is adjacent to one of the two lines of the positioning wheels 16.

Figure 4:
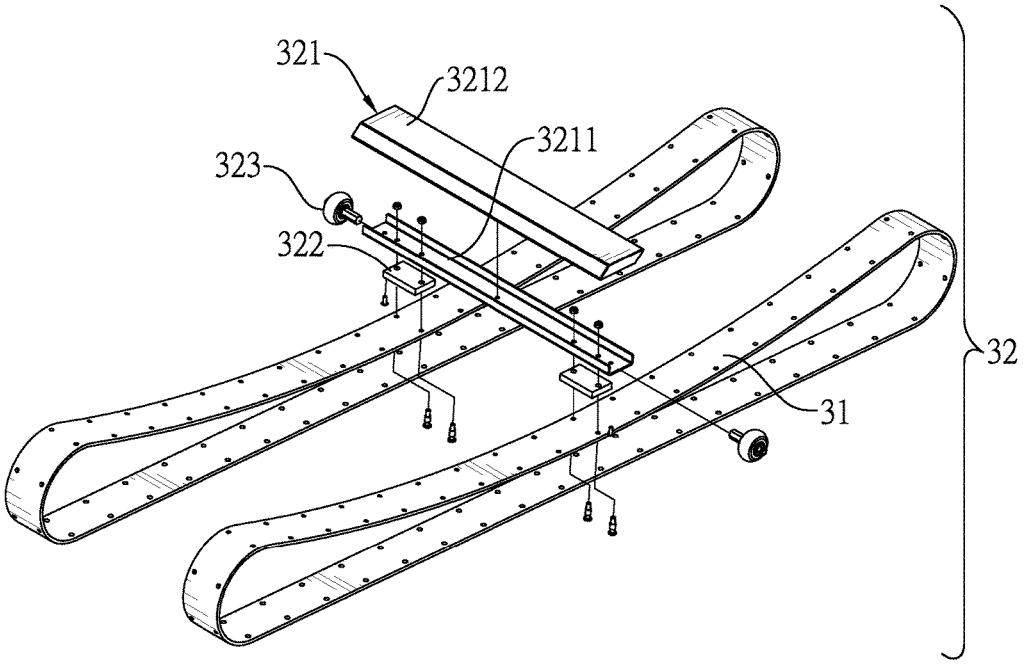
FIG. 4 is an exploded view of a belt assembly of the curved treadmill in FIG. 1.
Figure 5:
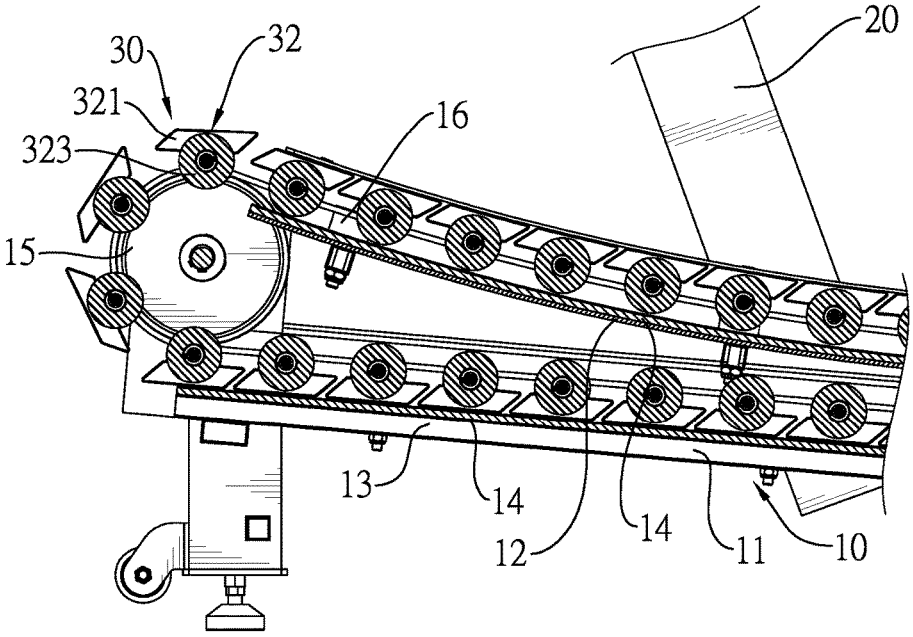
FIG. 5 is another sectional view of the curved treadmill in accordance with the present invention.
Figure 6:
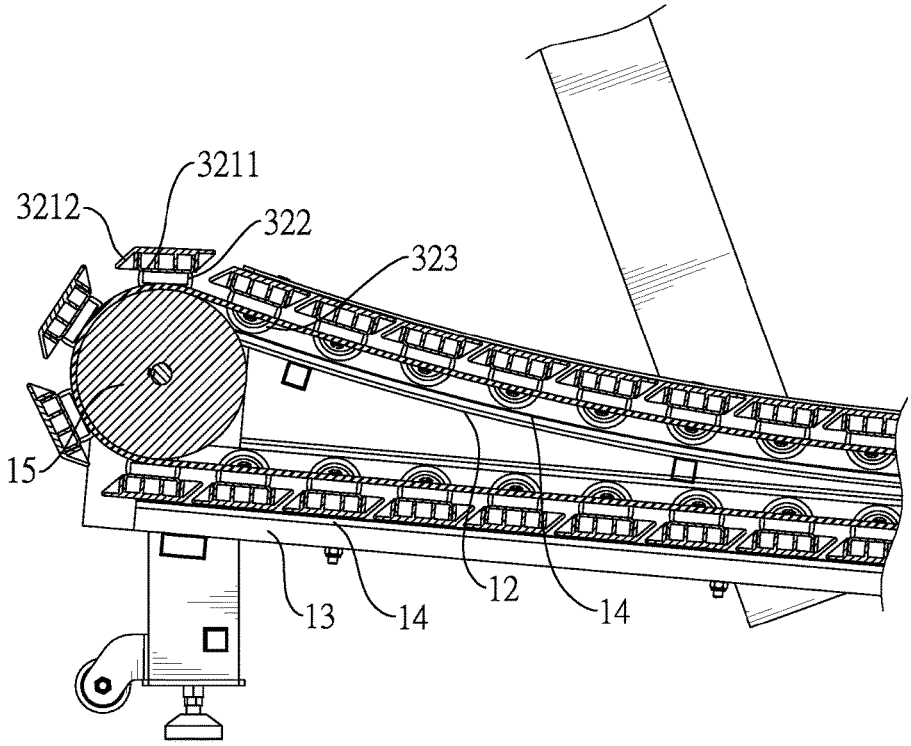
FIG. 6 is still another sectional view of the curved treadmill in accordance with the present invention.

With reference to FIGS. 4 to 6, the pedals 32 are securely mounted on the connection belts 31, are juxtaposed and connected to each other, and downward abut the cushions 14. Precisely, in this embodiment, each one of the pedals 32 comprises a plate body 321, two pads 322, and two rollers 323.

The plate bodies 321 of the pedals 32 are juxtaposed to each other, and each plate body 321 is securely mounted on the connection belts 31, and comprises a framework 3211 and a case 3212. A cross section of the framework 3211 is in a U-shape, which is open upward, and the case 3212 and the framework 3211 are sleeved together. In other words, the case 3212 may be sleeved on the framework 3211, or, conversely, the framework 3211 may be sleeved on the case 3212. One surface of each one of the pads 322 is securely mounted on an outer surface of the framework 3211, another surface of each pad 322 is securely mounted on one of the connection belts 31. In other words, the framework 3211 of the plate body 321 is mounted on the connection belts 31 by the pads 322.

The two rollers 323 are securely mounted at two ends of the framework 3211 of the plate body 321 respectively, and downward optionally abut the cushions 14 that are mounted on the two arced guide tracks 12 or the two straight guide tracks 13. The rollers 323 are made from polyurethane (PU).

With the aforesaid structure, when a user stamps on the pedals 32, the two rollers 323 may downward abut the cushions 14 on the arced guide tracks 12, so that the cushions 14 and the rollers 323 can absorb impact as a buffer. Thus, the pedals 32 and the arced guide tracks 12 may not generate noise when the rollers 323 and the cushions 14 collide. Besides, unlike the hollow-tube straight guide tracks 13, each arced guide track 12 is a sheet, so there is no resonant cavity in the arced guide tracks 12. Thus, a sound generated from each step of the user may not be magnified by the arced guide tracks 12. In addition, with one side of each connection belt 31 abutting or being adjacent to one of the two lines of the positioning wheels 16, when the user exercises on the curved treadmill of the present invention and lateral forces are exerted on the connection belts 31, the connection belts 31 may not be distorted sideward but keep straight.

Consequently, with each arced guide track 12 being a sheet and one cushion 14 mounted on the arced guide track 12, the impacts are absorbed and the noises are reduced. Besides, with the connection belts 31 abutting or adjacent to the positioning wheels 16, the connection belts 31 may not be distorted sideward but move smoothly around the support frame 11, so that the noises are reduced further.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A curved treadmill comprising:

a frame assembly comprising:

a support frame;

two arced guide tracks being concaved downward and disposed on two opposite sides of the support frame respectively;

two cushions mounted securely on upper surfaces of the two arced guide tracks respectively;

a plurality of guide wheels mounted on a front end and a rear end of the support frame; and a plurality of positioning wheels mounted between the front end and the rear end of the support frame;

a handrail assembly mounted on two opposite sides of the frame assembly and comprising a handrail; and a belt assembly wrapped around the frame assembly, and comprising:

at least one connection belt wrapped around the plurality of guide wheels, and one side of the at least one connection belt abutting or adjacent to the plurality of positioning wheels; and a plurality of pedals securely mounted on the at least one connection belt, juxtaposed and adjacent to each other;

wherein when some of the plurality of pedals are above the two cushions such that bottom surfaces of said some of the plurality of pedals abut the two cushions that are mounted on the two arced guide tracks.

2. The curved treadmill as claimed in claim 1, wherein each one of the plurality of pedals of the belt assembly comprises:

a plate body;

two pads, two opposite side surfaces of each one of the two pads securely mounted on the plate body and the at least one connection belt respectively; and two rollers mounted on two ends of the plate body respectively;

wherein when the two rollers are above the two cushions that are mounted on the two arced guide tracks such that bottom surfaces of the two rollers abut the two cushions that are mounted on the two arced guide tracks.

3. The curved treadmill as claimed in claim 2, wherein the plate body of each one of the plurality of pedals of the belt assembly comprises:

a framework, the two pads and the two rollers mounted on the framework; and a case, wherein the case and the framework are sleeved together.

4. The curved treadmill as claimed in claim 3, wherein the two rollers are made from polyurethane.

5. The curved treadmill as claimed in claim 4, wherein the frame assembly further comprises:

two straight guide tracks mounted on the two opposite sides of the support frame respectively and disposed below the two arced guide tracks respectively; and two cushions securely mounted on upper surfaces of the two straight guide tracks respectively;

wherein when the two rollers are below the two arced guide tracks and above the two cushions that are mounted on the two straight guide tracks such that bottom surfaces of the two rollers abut the two cushions that are mounted on the two straight guide tracks.

6. The curved treadmill as claimed in claim 5, wherein each one of the two arced guide tracks of the frame assembly is a sheet.

7. The curved treadmill as claimed in claim 2, wherein the two rollers are made from polyurethane.

8. The curved treadmill as claimed in claim 1, wherein the frame assembly further comprises:

two straight guide tracks mounted on the two opposite sides of the support frame respectively and disposed below the two arced guide tracks respectively; and two cushions securely mounted on upper surfaces of the two straight guide tracks respectively;

wherein when some of the plurality of pedals are below the two arced guide tracks and above the two cushions that are mounted on the two straight guide tracks such that bottom surfaces of said some of the plurality of pedals abut the two cushions that are mounted on the two straight guide tracks.

9. The curved treadmill as claimed in claim 8, wherein each one of the two arced guide tracks of the frame assembly is a sheet.

* * * * *